US005108308A

United States Patent [19]

Northcraft et al.

[11] Patent Number: 5,108,308

[45] Date of Patent: Apr. 28, 1992

[54] PYLON ACTUATED LOCKING EYELET

[75] Inventors: Shane D. Northcraft; John A. Pastor, both of New Cumberland; Mark R. Thumma, Oberlin, all of Pa.

[73] Assignee: AMP Incorporated, Harrisburg, Pa.

[21] Appl. No.: 709,038

[22] Filed: May 31, 1991

[51] Int. Cl.[5] ..... H01R 13/74

[52] U.S. Cl. ..... 439/555; 439/560; 29/739

[58] Field of Search ..... 29/739; 439/555, 560, 439/569, 573

[56] References Cited

U.S. PATENT DOCUMENTS 4,717,219 1/1988 Frantz et al. ..... 439/82
4,842,552 6/1989 Frantz ..... 439/557
4,871,320 10/1989 Mouissie ..... 439/78
4,884,336 12/1989 Waters et al. ..... 29/739 X

*Primary Examiner*—Eugene F. Desmond
*Attorney, Agent, or Firm*—Katherine A. Nelson

[57] ABSTRACT

Improved locking eyelets (2) for securing electrical components to a circuit board by support pylons. A surface-mount electrical connector (40) is anchored to a circuit board (60) by pylons (20) and eyelets (2) mounted at the tip of each pylon (20). Each eyelet (2) is provided with a number of elongate members (8) to allow one-way insertion of a pylon (20) therein. When an eyelet (2) is mounted on a pylon (20), and the pylon (20) is inserted through the circuit board, the pylon (20) causes eyelet (2) to expand at one end, thereby locking both eyelet (2) and pylon (20) within the circuit board.

20 Claims, 9 Drawing Sheets

PYLON ACTUATED LOCKING EYELET

CROSS-REFERENCE TO RELATED APPLICATIONS

This application is related to co-pending application, Ser. No. 07/709,007, entitled "Surface-Mount Solder-Tail Terminal Member".

FIELD OF THE INVENTION

The invention relates to a means for attaching electrical components to a circuit board and, in particular, to a pylon actuated eyelet for locking connectors and other electrical components to the surface of a circuit board without the need for specialized insertion tools.

BACKGROUND OF THE INVENTION

When assembling components on a circuit board, it is most convenient if the components are mounted on the board while their terminal members are soldered in place. For instance, a conventional surface-mount edge connector as shown in FIG. 1 should first be secured to the surface of the circuit board while all terminal members are soldered to the appropriate traces on the surface of the circuit board.

Various types of boardlocks have been developed for the above-described purpose. For example, the connector may be riveted to the circuit board prior to soldering. Riveting is both durable and permanent, and it has other advantages which extend beyond the manufacturing process. For instance, after manufacturing, the circuit board will inevitably absorb shocks and vibrations which would otherwise fracture the terminal member solder joints. Instead, the rivets absorb the shock. Unfortunately, specialized tools and procedures are required to insert the rivets during the manufacturing process. In addition, the connector housing must have protuberances by which the rivets may clasp the connector. For this purpose, mounting-ears are generally provided around the periphery of the connector housing. However, the mounting-ears consume valuable space on the surface of the circuit board.

Other well-known devices such as weldments and adhesives do nothing to solve the above-described problems. Fortunately, recent modifications and improvements have been more availing.

For example, in U.S. Pat. No. 4,842,552 issued to Frantz, a tolerance forgiving boardlock is disclosed. The Frantz '552 boardlock is employed in a manner similar to a rivet. However, installation is much easier. As shown in FIG. 2, each boardlock comprises a crown formed with a plurality of resilient legs extending downward along a longitudinal axis. The legs are formed with elbows along their length, i.e., the legs diverge, and then converge toward a common axis. The boardlocks are inserted through mounting-ears extending from the connector housing. During insertion, the resilient legs constrict until the elbows have cleared the circuit board. Once clear, the legs deflect radially outward. The elbows engage the underside of the circuit board to provide a secure resistance fit. The Frantz '552 boardlock eliminates the need for specialized insertion tools.

Moreover, the resilient legs are more accommodating of inexact manufacturing tolerances. Unfortunately, the interference fit of the Frantz '552 boardlock requires significant insertion force. This hinders the assembly process. Furthermore, the Frantz '552 boardlock does not protect the solder connections as would a rivet. When a substantial force is applied to the connector, it will be absorbed by the solder contacts as well as the boardlocks.

U.S. Pat. No. 4,717,219 to Frantz, et al. proposes a partial solution. A deformable boardlock is disclosed for insertion on the tip of a specialized insertion tool. The boardlock is inserted until its flanged head limits further insertion. At this point, the insertion tool bears on a concave indentation at the tip of the boardlock. Further insertion of the tool flattens the indentation, which in turn causes a flaring of the boardlock around the tip. As a result, the circuit board and connector tab became sandwiched between the flanged head and flared tip of the boardlock. Hence, the Frantz, et al. '219 boardlock provides a more permanent, durable and tolerance forgiving anchor.

Even though Frantz, et al. '219 provides an excellent anchor, the improvement complicates the manufacturing process. A customized insertion tool is necessary for assembly. Moreover, the connector must be held in alignment with the circuit board while the boardlocks are installed, and mounting-ears are required around the connector housing.

It would be greatly advantageous to eliminate the above-described drawbacks in an anchoring mechanism with a binding force equivalent to the Frantz, et al. '219 boardlock.

SUMMARY OF THE INVENTION

It is therefore an object of the present invention to provide a method and apparatus for securing a connector to the surface of a circuit board by downwardly extending pylons held by locking eyelets.

It is another object of the present invention to provide a locking eyelet which is self-actuated during hand-insertion of the connector pylons through the circuit board, thus eliminating the need for specialized insertion tools.

It is still another object of the present invention to provide a self-actuated locking eyelet for insertion through a circuit board on a connector pylon, the connector pylon bearing upon the eyelet to cause expansion at the protruding tip, thereby locking the eyelet and pylon in place.

It is a further object of the present invention to provide an eyelet as described above which can be inserted with minimal insertion force.

According to the present invention, these and other objects are accomplished by providing an improved boardlock for mounting an electrical component on a circuit board. The boardlock comprises a downwardly extending pylon for aligning and supporting the component on a circuit board, and a locking eyelet for securing the pylon to the circuit board. The eyelet further comprises an annular member having an open top end for insertion of a pylon, and a lower end for insertion through the circuit board. The eyelet is provided with means actuated by the pylon for expanding the eyelet at the lower end when the eyelet is inserted through the circuit board, thereby locking the eyelet in place. The eyelet is also provided with means for locking the pylon within the eyelet, thereby locking the pylon in place.

BRIEF DESCRIPTION OF THE DRAWING

Other objects, features and advantages of the present invention will become more apparent from the following detailed description of preferred embodiments and certain modifications thereof when taken together with the accompanying drawings, in which.

DETAILED DESCRIPTION OF THE PREFERRED EMBODIMENT

Figure 3:
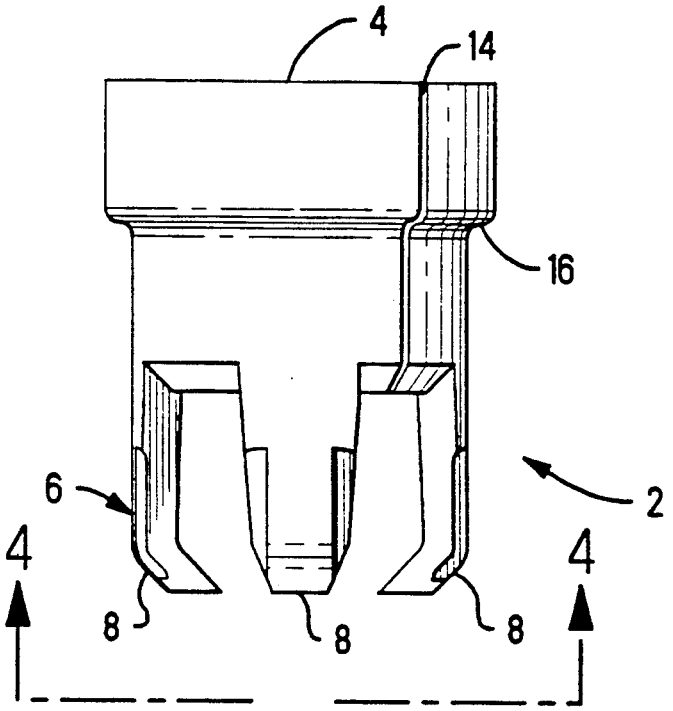
FIG. 3 is a perspective view of a locking eyelet according to a preferred embodiment of the present invention.
Figure 4:
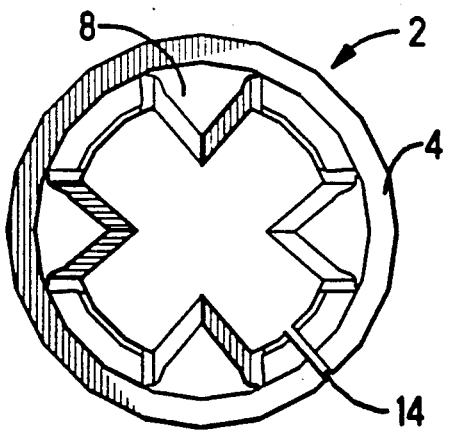
FIG. 4 is a bottom view of the eyelet of FIG. 3.

FIGS. 3 and 4 illustrate a perspective view, and a bottom view, respectively, of a locking eyelet according to a preferred embodiment of the present invention.

Eyelet 2 is stamped and formed with an upper end 4, a lower end 6 and seam 14. A flange 16 rims the eyelet 2 a measured distance from upper end 204 to limit insertion.

Eyelet 2 is formed with a plurality of integral elongate members 8 which extend directly downward from the lower end 6. Elongate members 8 are bent inward at the tip toward the cylindrical axis of the eyelet 2.

The entire operation of eyelet 2 will now be described with reference to FIGS. 5-10 in the context of mounting a connector 40 to a circuit board 60. A connector housing having integral pylons is being used for purposes of illustrating the invention. It is to be understood that the eyelet of the present invention may also be used with metal members such as pins which may be inserted into the housing. It should be noted, however, that the invention is equally applicable to mounting any component on a circuit board.

Figure 5:
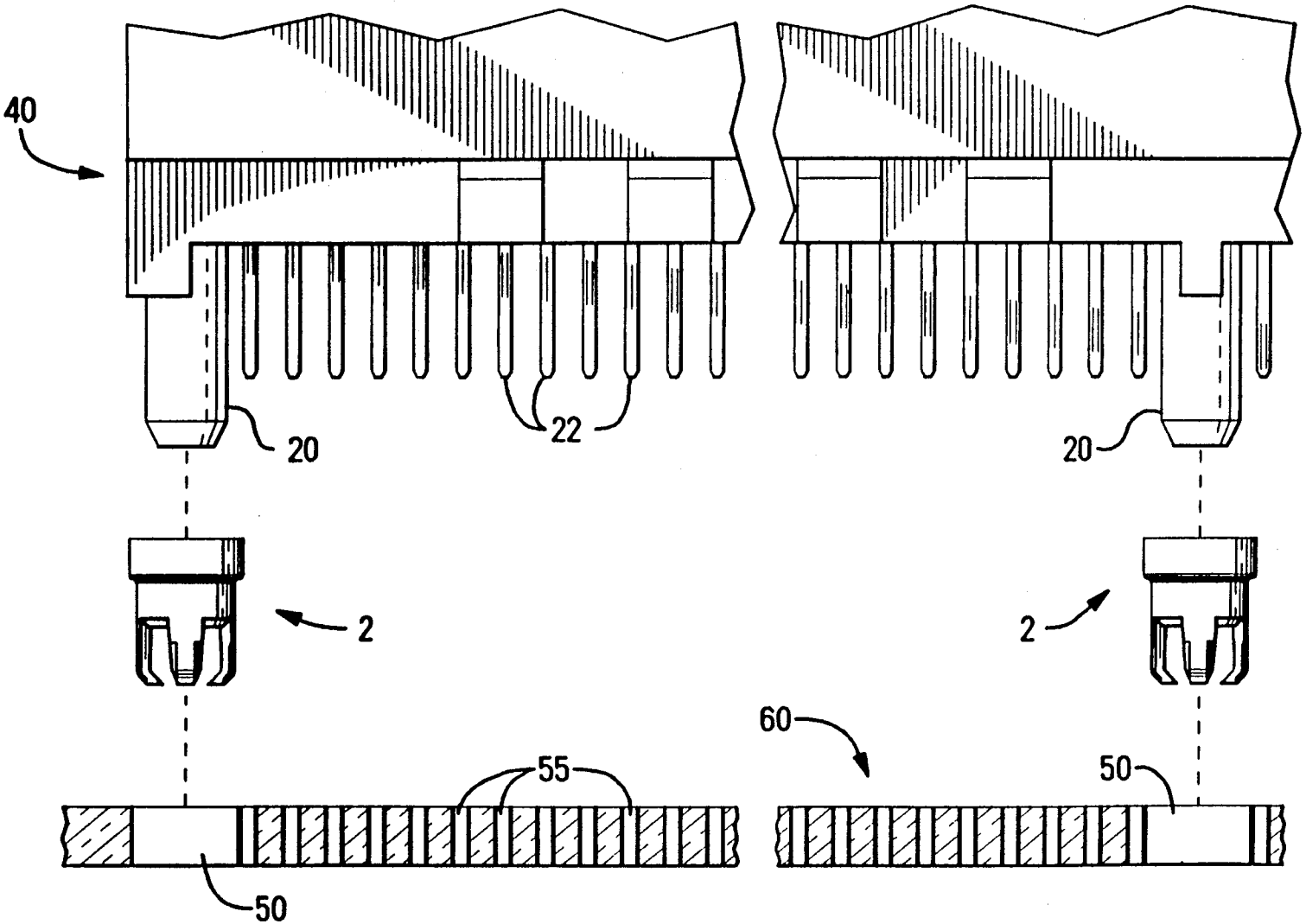
FIGS. 5-9 illustrate the insertion sequence and operation of an eyelet according to the present invention.

As shown in FIG. 5, an eyelet 2 is mounted at the tip of each pylon 20 extending downwardly from connector 40. At least one pylon 20 and eyelet 2 are required to secure the connector 40 to the circuit board 60 during the soldering operation.

Figure 6:
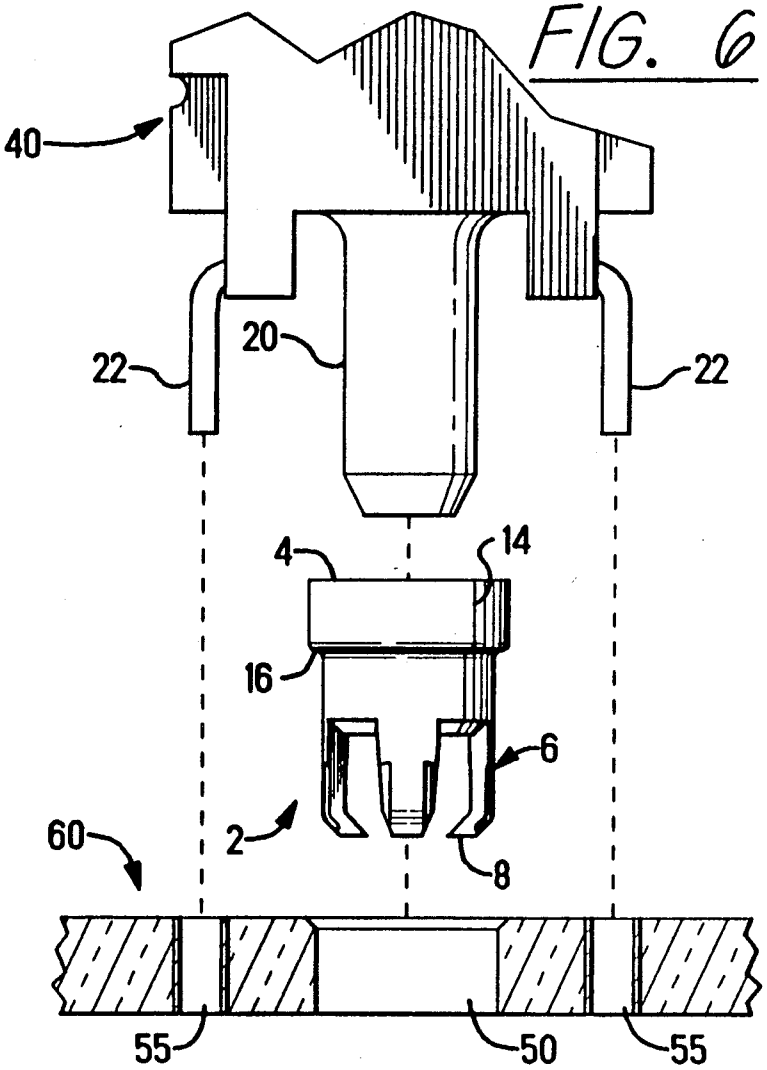

As shown in FIG. 6, connector 40 is also provided with a plurality of terminal members 22 for completing electrical connections to corresponding traces on circuit board 60. Preferably, each pylon 20 is interspaced between terminal members 22. Circuit board 60 is pre-drilled at hole 50 to receive pylon 20. Preferably, pre-drilled hole 50 is tapered to facilitate insertion.

Figure 1:
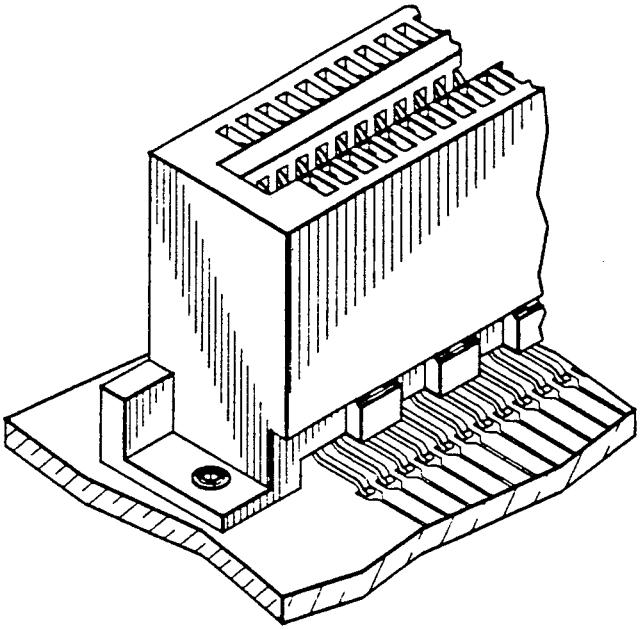
FIG. 1 PRIOR ART
FIG. 1 is a prior art illustration of a surface mount connector.
Figure 2:
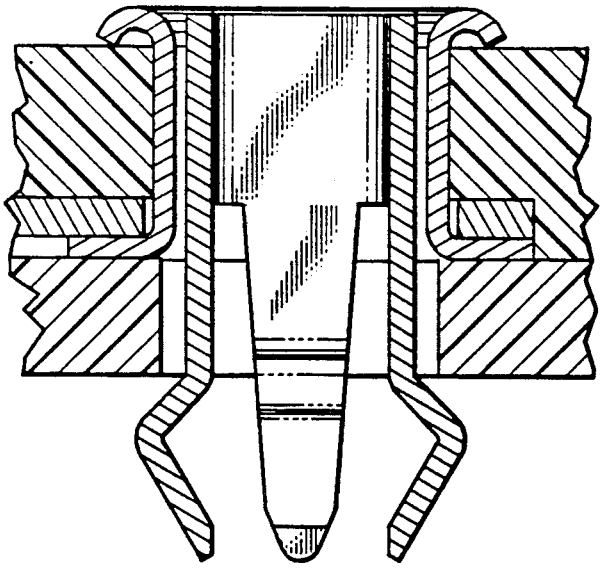
FIG. 2 PRIOR ART
FIG. 2 is a cross-sectional diagram of a prior art boardlock used for anchoring the connector of FIG. 1.

Likewise, circuit board 60 may be pre-drilled with a plurality of smaller holes 55 each designed to receive a corresponding one of terminal members 22. Alternatively, surface-mount technology may be incorporated as shown in FIG. 1 and described in related pending U.S. application Ser. No. 07/709,007, entitled "Surface-Mount Solder-Tail Terminal Member". In this case, terminal members 22 are surface-mounted to traces extending along the top surface of a circuit board.

Figure 7:
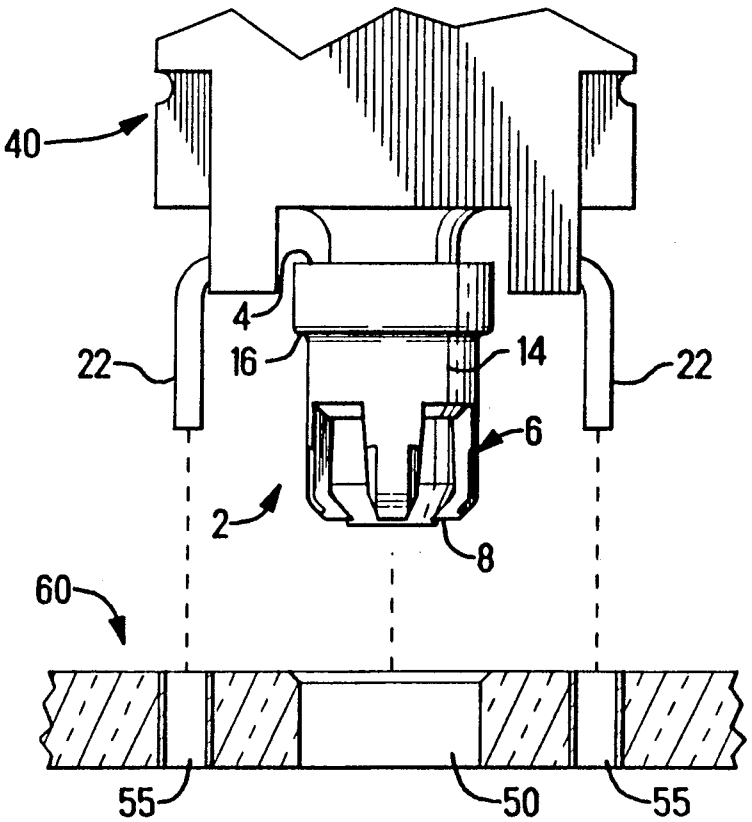

As more clearly shown in FIG. 7, the elongate members 208 allow uni-directional insertion of pylon 20 within eyelet 2. Preferably eyelet 2 is dimensioned to provide a light frictional fit around pylon 20 prior to insertion in the board. Once eyelet 2 is inserted on pylon 20, connector 40 is assembled on the surface of circuit board 60 by inserting eyelet 2 and pylon 20 through pre-drilled hole 50 in circuit board 60. Pylon 20 extends past terminal members 22 so that insertion serves to align terminal members 22 with their respective holes 55.

Figure 8:
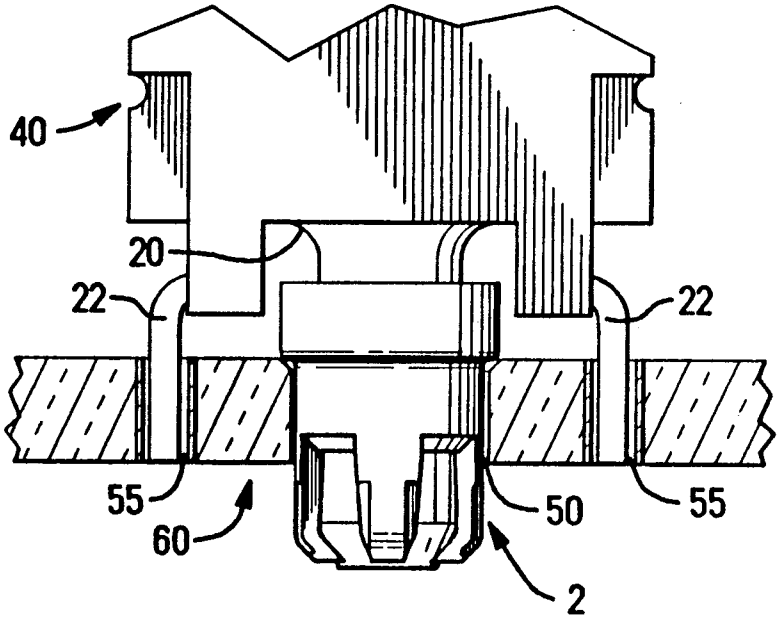

As shown in FIG. 8, pylon 20 with eyelet 2 is inserted into pre-drilled hole 50 until flange 16 abuts the top surface of the circuit board 60. When flange 16 limit further insertion, the pylon continues through eyelet 2 and bears against the inwardly inclined tips of elongate members 8. Further insertion of pylon 20 urges elongate members 8 outwardly.

Figure 9:
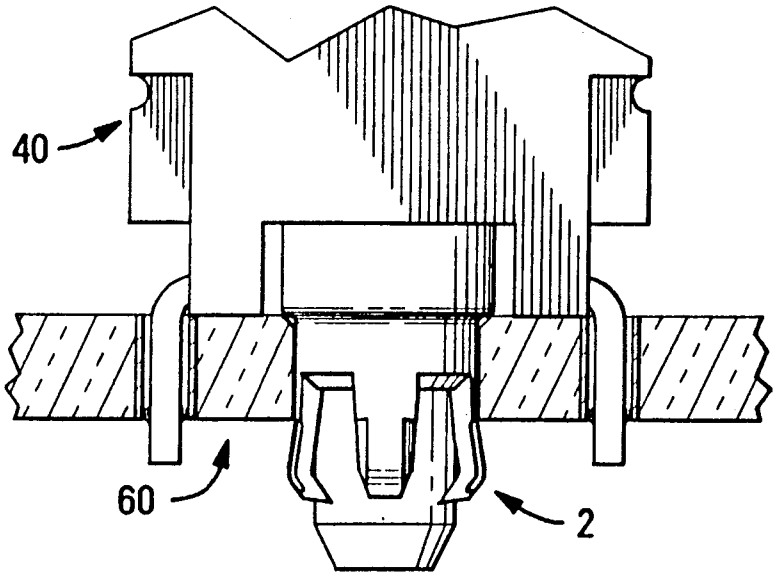

As shown in FIG. 9, elongate members 8 are urged outwardly and are forced apart by the driving pylon 20. The degree of bend in elongate members 8 exceeds the diameter of hole 50. Hence, when fully inserted, eyelet 2 is permanently locked within pre-drilled hole 50, and pylon 20 is likewise locked within eyelet 2.

Consequently, eyelet 2 provides a permanent anchor for pylon 20. In addition, eyelet 2 completely covers pre-drilled hole 50 to prevent solder from splashing upward through hole 50 during wave-soldering. The eyelet 2 has an extremely high retention strength in binding the connector 40 to the circuit board 60, and pylon 20 will absorb impacts tending to jar connector 40. This prevents breakage of the solder joints.

As a comparison, a connector using prior art boardlocks are able to withstand approximately 4 to 8 pounds of separation force. In contrast, the hold down strength of a connector according to the present invention is approximately 14 to 16 pounds. Moreover, the connector of the present invention conserves space, and can be installed without insertion tools.

Figure 10:
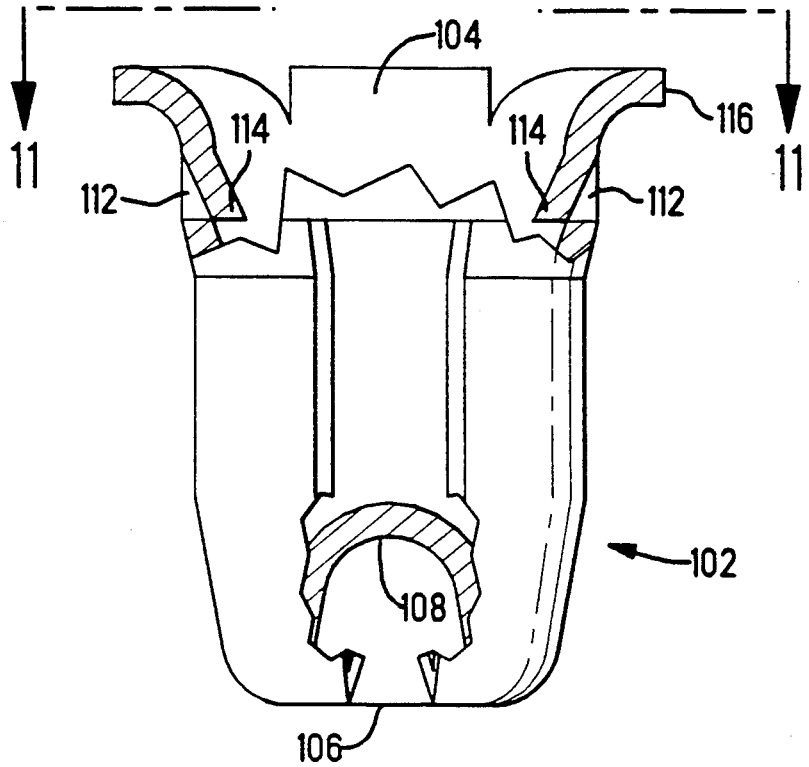
FIG. 10 is a cross-sectional view of a locking eyelet according to a second embodiment of the present invention.
Figure 11:
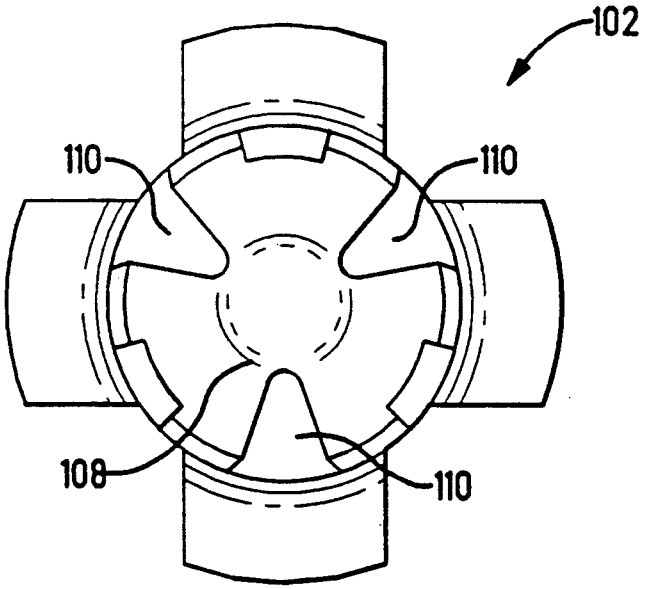
FIG. 11 is a top view of the eyelet of FIG. 10.

FIGS. 10 and 11 illustrate a cross-sectional view, and a top view, respectively, of a second embodiment of a locking eyelet 102 according to the present invention.

Eyelet 102 is formed with an upper end 104 and a closed lower end 106. Eyelet 102 is preferably tapered at lower end 106 to facilitate insertion through a circuit board. A flange 116 rims the upper end 104 to limit insertion.

Near the open end 104, eyelet 102 is punched inwardly, and a section above each groove 112 is depressed during the punching operation to form a resilient locking tab 114 which allows one-way insertion of a connector pylon within eyelet 102.

Figure 13:
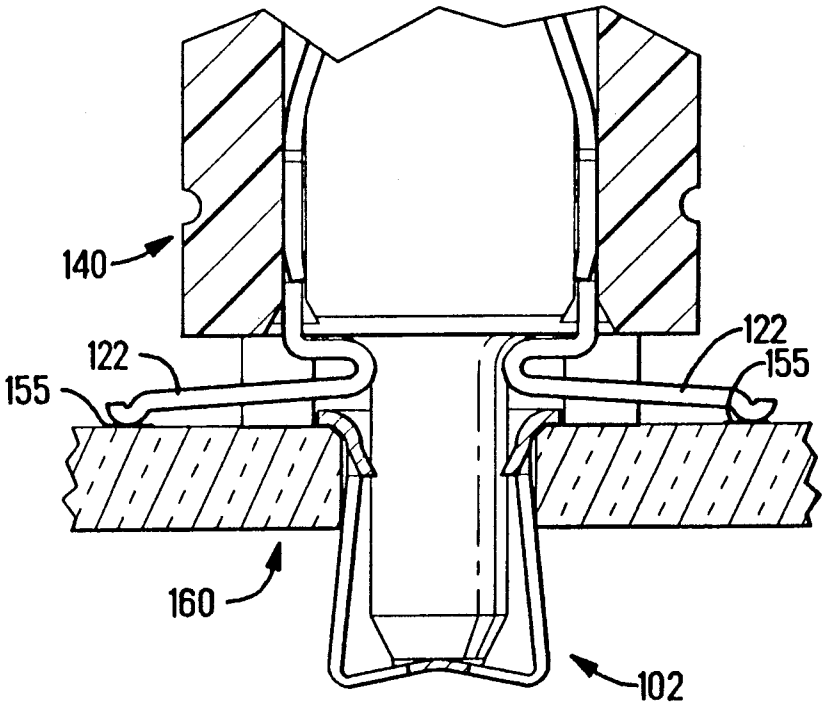
FIGS. 12 and 13 illustrate the final steps in the insertion sequence of the eyelet of FIG. 10.
Figure 12:
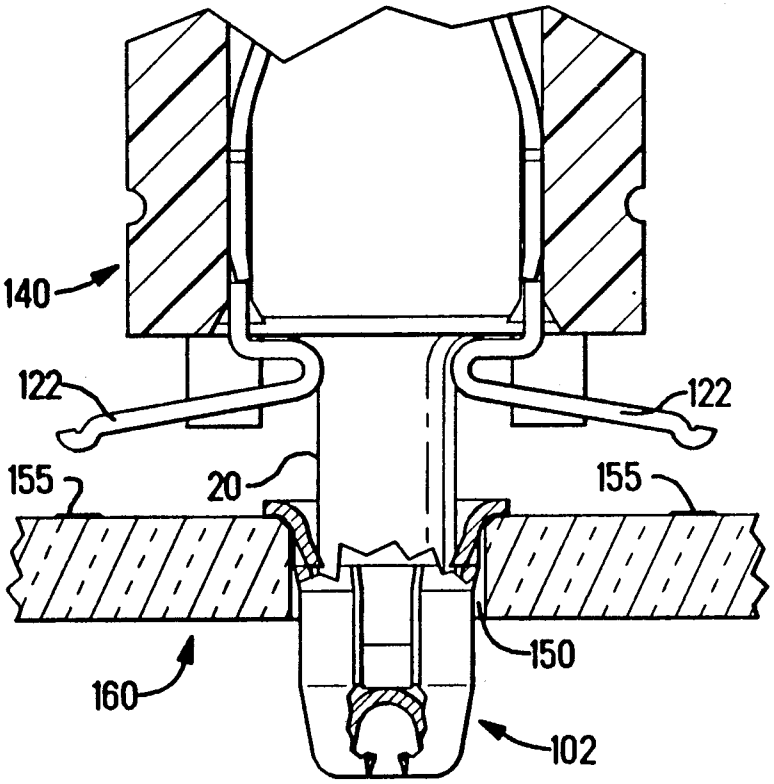

Eyelet 102 is also formed with a plurality of triangular divisions 110 along the walls at equi-spaced intervals around the periphery, the divisions 110 extend from open end 104 to an apex at closed end 106. Divisions 110 are designed to accommodate flaring of the eyelet 102 around closed end 106. The flaring is generated by a concave indentation or dimple 108 formed integrally with the walls of eyelet 102 and extending interiorly of the lower end 106. During insertion, as shown in FIGS. 12 and 13, the pylon drives dimple 108 downwardly. As dimple 108 flattens, an expansion of closed end 106 occurs. The divisions 110 accommodate the expansion to allow flaring of closed end 106. The flared closed end 106 exceeds the diameter of the pre-drilled hole 155 through the circuit board 160, and eyelet 102 become permanently locked therein. Likewise, the pylon 20 is locked within eyelet 102. Hence, eyelet 102 provides an equally dependable anchor without use of insertion tools.

FIGS. 12 and 13 illustrate the use of eyelet 102 on connector 140 having surface mount terminal members 122 adapted to electrically engage circuit pads 155 on the surface of circuit board 160.

Figure 14:
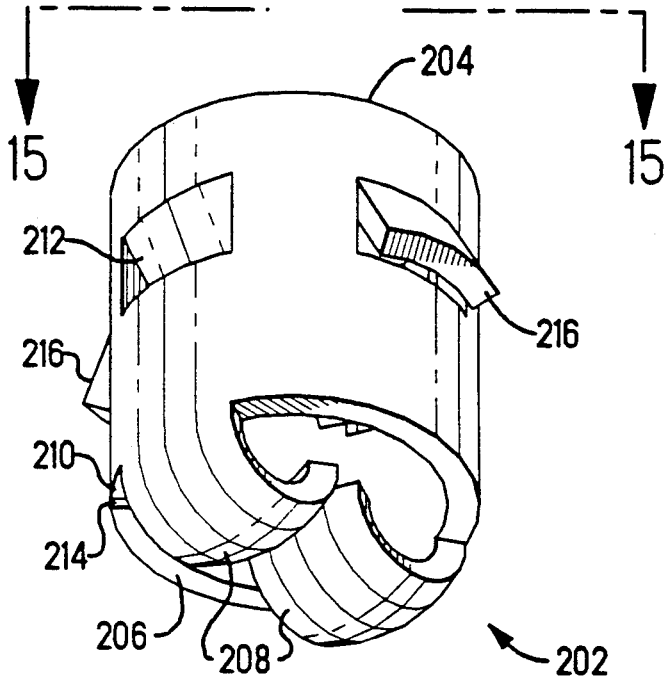
FIG. 14 is a cross-sectional view of a locking eyelet according to a third embodiment of the present invention.
Figure 15:
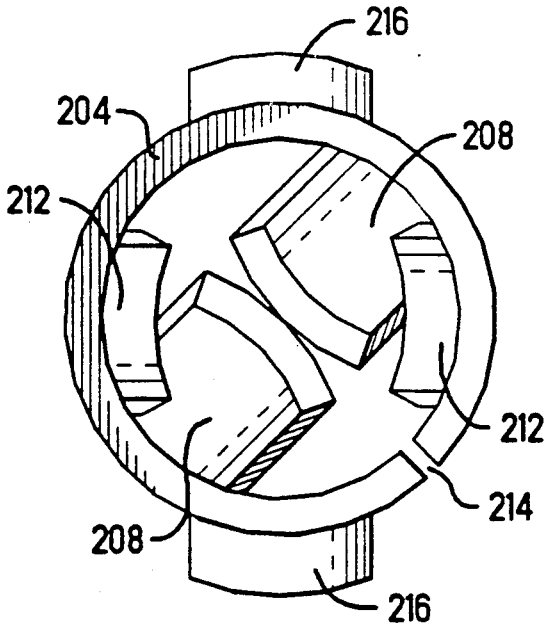
FIG. 15 is a top view of the eyelet of FIG. 10.

FIGS. 14 and 15 illustrate a cross-sectional view, and a top view, respectively, of a third embodiment of a locking eyelet 202 according to the present invention.

As shown, eyelet 202 has a generally annular shape which facilitates production by rolling a thin strip of conductive material, such as copper, brass, or any other material known in the art. The rolling operation results in a cylindrical eyelet 202 having an inner diameter conforming to the diameter of a pylon to be inserted therein. Eyelet 202 has an upper end 204 which is open, and a lower end 206 which is to be inserted through a pre-drilled hole in a circuit board.

Near upper end 20, eyelet 20 is punched outward to form one or more projections 216. Projections 216 are spaced from upper end 204 to limit insertion of the eyelet 202 through a circuit board.

Similarly, at least one section of the wall of eyelet 202 near the upper end 204 is punched inwardly. The punching operation cuts and depresses the wall section to form a resilient locking tab 212. Locking tab 212 allows one-way insertion of a pylon within eyelet 202. Upon insertion, the pylon depresses resilient locking tab 212 as it is advanced toward closed end 206. However, if removal of the pylon is attempted, the locking tab 112 grips the pylon, thereby preventing extraction.

At the lower end 206, eyelet 202 is formed with a pair of integral elongate members 208 which are curled inward toward the cylindrical axis. Elongate members 208 are designed to lock eyelet 202 in place when bent outwardly by a pylon inserted through the eyelet.

Figure 17:
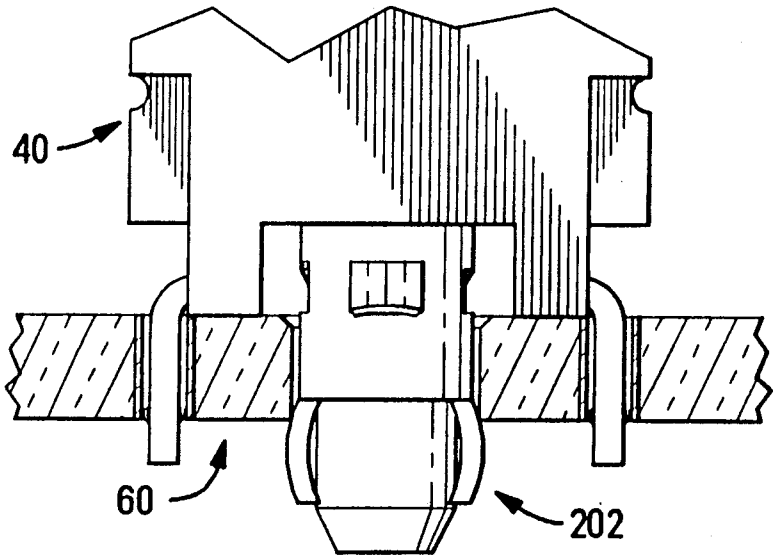
FIGS. 16 and 17 illustrate the final steps in the insertion sequence of the eyelet of FIG. 14.
Figure 16:
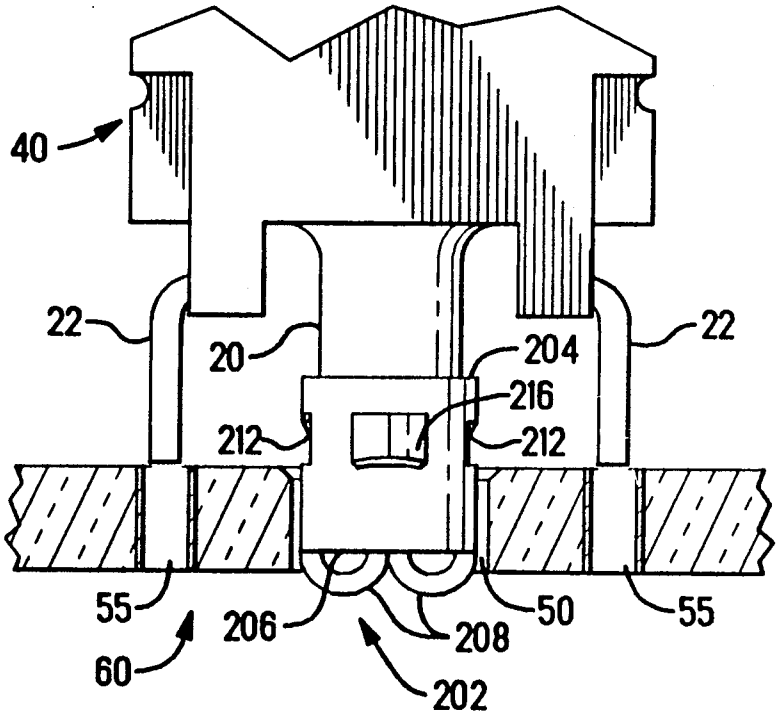

In operation, as shown in FIGS. 16 and 17, eyelet 202 is inserted on a pylon, and the pylon is inserted through a pre-drilled hole in a circuit board until projections 216 abuts the top surface of the circuit board. When projections 216 limits further insertion, the pylon continues through eyelet 202 and bears against the inwardly inclined tips of curled members 208. Further insertion of the pylon urges the resilient curled members 208 outwardly. When the pylon is fully inserted, the degree of curvature in curled members 208 exceeds the diameter of the pre-drilled hole. Hence, eyelet 202 becomes locked within the pre-drilled hole. In sum, eyelet 202 provides an equally dependable pylon-actuated anchor without use of insertion tools.

Having now fully set forth the preferred embodiments and certain modifications of the concept underlying the present invention, various other embodiments as well as certain variations and modification of the embodiment herein shown and described will obviously occur to those skilled in the art upon becoming familiar with said underlying concept. It is to be understood, therefore, that within the scope of the appended claims, the invention may be practiced otherwise than as specifically set forth herein.

We claim:

1. A locking eyelet for securing an electrical component to a circuit board, the eyelet comprising an annular member having an open first end for insertion of a pylon, a second end for insertion through said circuit board, means for anchoring said eyelet in said circuit board, said anchoring means being actuated by insertion of said pylon within said eyelet, and means for inhibiting extraction of said pylon.

2. The eyelet according to claim 1, wherein said annular member further comprises a flange around said first end for limiting insertion into said circuit board.

3. The eyelet according to claim 1, wherein said means for inhibiting extraction of said pylon further comprises a section along a periphery of said annular member punched inwardly to define a resilient locking tab, whereby said tab grips said pylon to prevent extraction.

4. The eyelet according to claim 1, wherein said anchoring means comprises a plurality of elongate members integral with said second end and extending therefrom, said elongate members each having a tip inclined toward a central axis of said eyelet, whereby a pylon inserted within said eyelet urges said elongate members outwardly to anchor said eyelet within said circuit board.

5. The eyelet according to claim 4, wherein said annular member is provided with a flange around said first end for limiting insertion in said circuit board and said means for inhibiting extraction of said pylon comprises a section along a periphery of said annular member punched inwardly to define a resilient locking tab, whereby said pylon may be uni-directionally inserted in said eyelet, and said eyelet inserted through said circuit board until said flared first end of said eyelet terminates insertion, said pylon thereupon bending said elongate members to lock said pylon within said circuit board.

6. The eyelet according to claim 1, wherein said anchoring means comprises a plurality of projections integral with said second end and extending therefrom, said projections curling interiorly of said eyelet toward a central axis, whereby a pylon inserted within said eyelet bends said projections outwardly anchor said eyelet within said circuit board.

7. The eyelet according to claim 6, wherein said annular member is provided with an outwardly punched section along a periphery of said annular member for limiting insertion of said member in said circuit board, and is further provided with a section along a periphery of said annular member punched inwardly to defined a resilient locking tab, whereby said pylon may be unidirectionally inserted into said eyelet, and said eyelet inserted through said circuit board until said outwardly extending peripheral section of said eyelet terminates insertion, said pylon thereupon bending said projections to lock said pylon within said circuit board.

8. The eyelet according to claim 1, wherein said anchoring means comprises a concave indentation formed integrally with said annular member and enclosing said second end, whereby a pylon inserted within said eyelet bears against and flattens said indentation, thereby causing said eyelet to flare at said second end.

9. The eyelet according to claim 8, wherein said second end of said annular member is closed, said closed end of said annular member being punched inward to form said second indentation.

10. A connector assembly, comprising:

a connector housing;

at least one pylon extending from beneath said housing for mounting said connector on a first circuit board;

a plurality of terminal members arranged within said connector housing for establishing an electrical contact with said first circuit board; and at least one locking eyelet for securing said electrical connector to said first circuit board by a pylon, said eyelet comprising an annular member having an open first end for insertion of a pylon, a second end for insertion through said first circuit board, and means for anchoring said eyelet in said first circuit board, said anchoring means being actuated by insertion of said pylon through said eyelet.

11. The connector assembly according to claim 10 wherein said anchoring means comprises a plurality of projections integral with said second end and extending therefrom, said projections curling interiorly of said eyelet toward a central axis, whereby a pylon inserted within said eyelet bends said projections outwardly to anchor said eyelet within said circuit board.

12. The connector assembly according to claim 10 wherein said anchoring means comprises a concave indentation formed integrally with said annular member and enclosing said second end, whereby a pylon inserted within said eyelet bears against and flattens said indentation, thereby causing said eyelet to flare at said second end.

13. The connector assembly according to claim 10 wherein said annular member further includes a flange around said first end for limiting insertion into said circuit board.

14. The connector assembly according to claim 10 wherein said annular member of said at least one locking eyelet further includes means for inhibiting extraction of said pylon from said eyelet.

15. The connector assembly according to claim 14 wherein said means for inhibiting extraction of said pylon further comprises a section along a periphery of said annular member punched inwardly to define a resilient locking tab, whereby said tab grips said pylon to prevent extraction.

16. The connector assembly according to claim 10 wherein said anchoring means comprises a plurality of elongate members integral with said second end and extending therefrom, said elongate members each having a tip inclined toward a central axis of said eyelet, whereby a pylon inserted within said eyelet urges said elongate members outwardly to anchor said eyelet within said circuit board.

17. The connector assembly according to claim 16 wherein said annular member is provided with an outwardly punched section along a periphery of said annular member for limiting insertion of said member into said first circuit board, and is further provided with an inwardly punched section along a periphery of said annular member to define a resilient locking tab, whereby said pylon may be uni-directionally inserted into said eyelet, and said outwardly extending punched section of said eyelet stops insertion of said eyelet into said board, said pylon thereupon bending said elongate members to lock said pylon within said first circuit board.

18. A method for securing an electrical component to a circuit board by a support pylon using an annular eyelet, comprising the steps of:

inserting a support pylon of said component into an open upper end of said eyelet;

inserting a lower end of said eyelet through a circuit board; and driving said pylon against said lower end to expand said lower end, thereby locking said eyelet within said circuit board.

19. The method according to claim 18, further comprising the step of preventing extraction of said pylon from said eyelet, thereby locking said component within said circuit board.

20. The method according to claim 18, whereby said lower end of said eyelet is covered by an integral concave dimple, and said step of driving said pylon against said lower end flattens said dimple, thereby causing said eyelet to flare at said closed end for locking said pylon within said circuit board.

* * * * *